US011596233B2

(12) United States Patent
Lawson et al.

(10) Patent No.: US 11,596,233 B2
(45) Date of Patent: Mar. 7, 2023

(54) COMPACT ADJUSTABLE RECLINING MECHANISM FOR A THEATER SEATING UNIT WITH PLANAR BACK DROP

(71) Applicant: L&P PROPERTY MANAGEMENT COMPANY, South Gate, CA (US)

(72) Inventors: Gregory Mark Lawson, Tupelo, MS (US); Cheston Brett Crawford, Randolph, MS (US)

(73) Assignee: L&P PROPERTY MANAGEMENT COMPANY, South Gate, CA (US)

( * ) Notice: Subject to any disclaimer, the term of this patent is extended or adjusted under 35 U.S.C. 154(b) by 0 days.

(21) Appl. No.: 17/539,532

(22) Filed: Dec. 1, 2021

(65) Prior Publication Data

US 2022/0175139 A1 Jun. 9, 2022

Related U.S. Application Data

(63) Continuation of application No. 15/931,780, filed on May 14, 2020, now Pat. No. 11,213,127.

(51) Int. Cl.
*A47C 1/032* (2006.01)
*A47C 1/12* (2006.01)

(52) U.S. Cl.
CPC ..... *A47C 1/03294* (2013.01); *A47C 1/03211* (2013.01); *A47C 1/03216* (2013.01); *A47C 1/12* (2013.01)

(58) Field of Classification Search
CPC ..... A47C 4/02; A47C 1/12; A47C 1/03294
See application file for complete search history.

(56) References Cited

U.S. PATENT DOCUMENTS

| | | | | |
|---|---|---|---|---|
| 5,876,094 | A * | 3/1999 | Hoffman | A47C 1/0352 297/267.1 |
| 10,376,060 | B2 | 8/2019 | Marcantoni | |
| 10,420,422 | B2 | 9/2019 | Lawson et al. | |
| 2015/0272329 | A1 | 10/2015 | Lawson | |
| 2021/0100364 | A1 | 4/2021 | Murphy | |

FOREIGN PATENT DOCUMENTS

| | | | | |
|---|---|---|---|---|
| WO | WO-03007758 | A1 * | 1/2003 | A47C 1/12 |
| WO | WO-2007144436 | A * | 12/2007 | A47C 1/12 |

* cited by examiner

*Primary Examiner* — Milton Nelson, Jr.
(74) *Attorney, Agent, or Firm* — Shook Hardy & Bacon, LLP

(57) ABSTRACT

A compact recliner mechanism for use in theater seating units is provided that allows the seat to move linearly as the seating unit moves from the closed position to the reclined position. The mechanism has a back bracket coupled to the seat plate and base plate with a linkage that moves a projected point representing the top of the back of the seating unit downwardly in vertical plane as the seating unit moves from the closed position to the reclined position. In other aspects, the seating unit has an armrest linkage coupled between the seat plate and the back that maintains an armrest lever at a horizontal orientation. Additionally, in some aspects, the base plate of the seating unit may have an adjustment feature that limits recline of the seating unit, to accommodate theater seating with different riser dimensions, and/or legs with an adjustment feature to level the seating unit on existing theater floors.

8 Claims, 14 Drawing Sheets

COMPACT ADJUSTABLE RECLINING MECHANISM FOR A THEATER SEATING UNIT WITH PLANAR BACK DROP

CROSS-REFERENCE TO RELATED APPLICATIONS

This application claims priority to U.S. patent application Ser. No. 15/931,780, filed May 14, 2020, and titled "COMPACT ADJUSTABLE RECLINING MECHANISM FOR A THEATER SEATING UNIT WITH PLANAR BACK DROP," which is assigned to the same entity as the present application, and is incorporated herein by reference in the entirety.

BACKGROUND

The present invention relates broadly to motion furniture and motion furniture mechanisms for the movie theater industry. More particularly, the present invention relates to an improved reclining mechanism developed to accommodate a wide variety of installation conditions, and provide a mechanism that: allows easy maintenance and cleaning; accommodates different styles of bases; provides a compact size allowing for shrouding; moves the top of the back of the seating unit in a planar fashion; and that allows an integrated armrest to remain horizontal while the seat and back change positions.

Movie theaters have been removing fixed seat and back chairs and replacing them with motion seating, where the back and seat are allowed to move, or recline, providing customers with an enhanced experience. As these upgrades take place, challenges are faced as the existing floors of movie theaters may have different configurations, such as the slope of the floor and/or the riser dimensions. Additionally, movie theaters may prefer a seating unit that has legs supporting the seating unit for a more traditional look, but some may prefer a more-modern pedestal styling. In either configuration, the movie theater typically desires a seating unit that is attractive, easy to maintain and clean. In some environments, movie theaters may also want a seating unit that allows for shrouding. This shrouding can be around the base of the seating unit, to prevent material from getting under the base and/or around the back and sides of the seating unit to provide a more private experience. Finally, as motion seating units are installed, the movie theater may desire armrests that remain horizontal as the seating unit moves between closed and reclined positions. It would be advantageous to provide a mechanism that addresses the above design options.

BRIEF SUMMARY OF THE INVENTION

Accordingly, one aspect of the present invention seeks to provide a compact recliner mechanism for use in theaters. At a high level, the seating unit is constructed to allow the seat to move linearly as the seating unit moves from the closed position to the reclined position. The seat plate moves relative to a base plate, carried at the front by a front carrier link and a front swing link and at the back by a rear carrier link and rear swing link. The distances of the pivot points at the front for the front swing link, between the seat plate and the front carrier link are the same as the pivot points for the front carrier link between the base plate and the front swing link. Similarly, the distances of the pivot points at the back for the rear swing link, between the seat plate and the rear carrier link are the same as the pivot points for the rear carrier link between the base plate and the rear swing link. These pivotal linkages at the front and rear allow any point on the seat plate to translate linearly as the seating unit moves from the closed position to the reclined position. Additionally, the seating unit has a back bracket coupled to the seat plate and base plate with a linkage that moves a projected point representing the top of the back of the seating unit downwardly in vertical plane as the seating unit moves from the closed position to the reclined position. This allows a rear shroud to be installed at the rear of the seating unit, without interference from the back as the seating unit reclines. This also allows adequate spacing between rows of theater seating units, even as users recline the seating units. In other aspects, the seating unit has an armrest linkage coupled between the seat plate and the back that maintains an armrest lever (to which an armrest can be attached) at a horizontal orientation as the seating unit moves from the closed to the reclined position. Additionally, in some aspects, the base plate of the seating unit may have an adjustment feature that limits the recline of the seating unit, to accommodate theater seating with different riser dimensions. In other aspects, the seating unit may have legs with an adjustment feature to level the seating unit on existing theater floors having either a positive or negative slope.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF THE SEVERAL VIEWS OF THE DRAWING

In the accompanying drawings which form a part of the specification and which are to be read in conjunction therewith, and in which like reference numerals are used to indicate like parts in the various views.

DETAILED DESCRIPTION OF THE INVENTION

The subject matter of aspects of the present invention is described with specificity herein to meet statutory requirements. However, the description itself is not intended to limit the scope of this patent. Rather, the inventors have contemplated that the claimed subject matter might also be embodied in other ways, to include different features or combinations of features similar to the ones described in this document, in conjunction with other present or future technologies. Further, it should be appreciated that the figures do not necessarily represent an all-inclusive representation of the embodiments herein and may have various components hidden to aid in the written description thereof.

Aspects hereof may be described using directional terminology. For example, the Cartesian coordinate system may be used to describe positions and movement or rotation of the features described herein. Accordingly, some aspects may be described with reference to three mutually perpendicular axes. The axes may be referred to herein as lateral, longitudinal, and vertical. For example, the terms "vertical" and "vertically" as used herein refer to a direction perpendicular to each of the lateral and longitudinal axes. As a further example, the longitudinal axis may extend in a front-to-back direction of a seating unit and the lateral axis may extend in a side-to-side direction of the seating unit. Additionally, relative location terminology will be utilized herein. For example, the term "proximate" is intended to mean on, about, near, by, next to, at, and the like. Therefore, when a feature is proximate another feature, it is close in proximity but not necessarily exactly at the described location, in some aspects. Additionally, the term "distal" refers to a portion of a feature herein that is positioned away from a midpoint of the feature.

Figure 1:
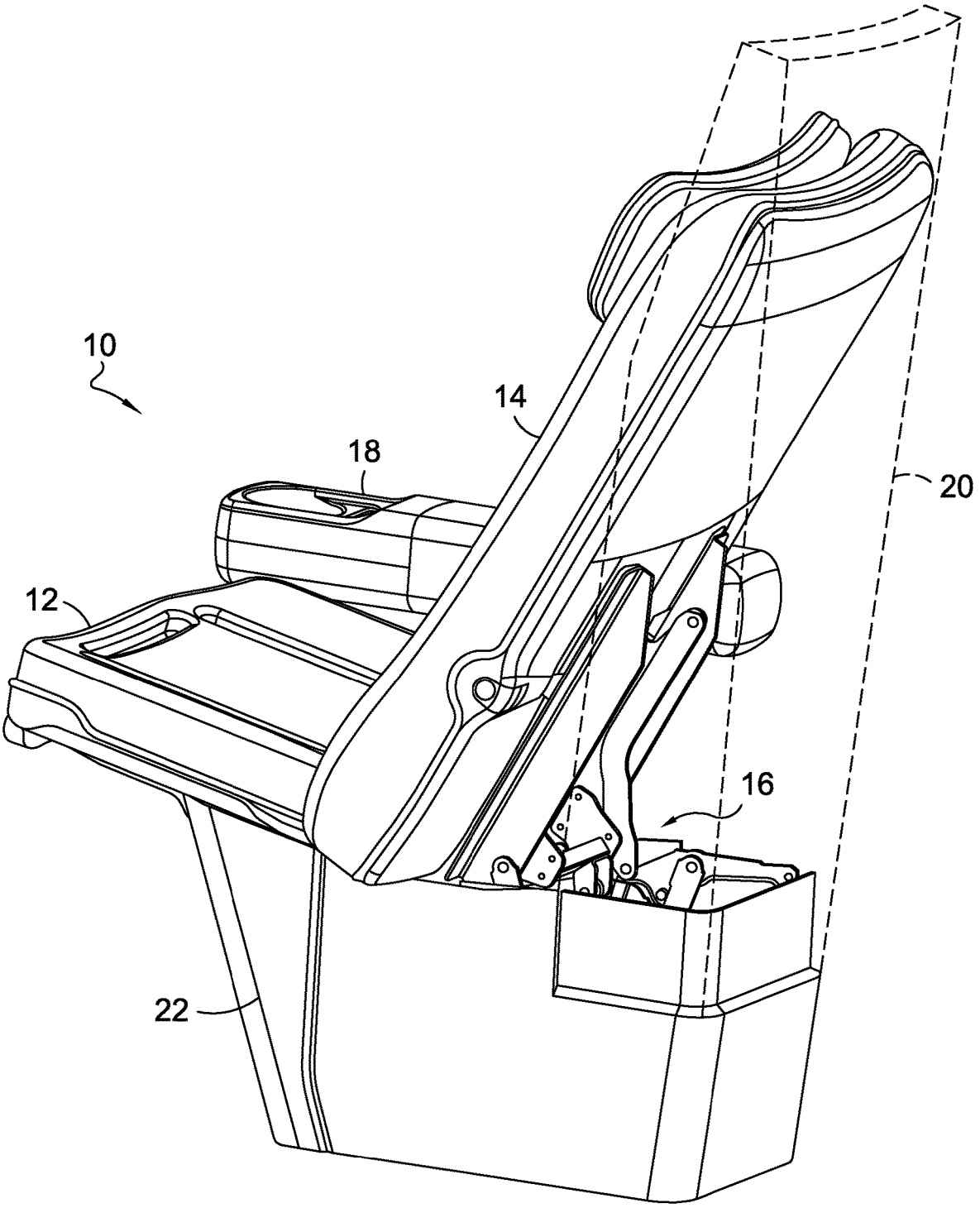
FIG. 1 is a side perspective view of a seating unit in a reclined position, with a base shroud shown in solid lines and a back shroud shown in hidden lines, in accordance with aspects hereof.

FIG. 1 illustrates a reclining seating unit 10 for use in a theater. As shown in FIG. 1, the reclining seating unit 10 includes a seat 12 and a back 14. A reclining mechanism 16 controls the movement of the seat 12 and back 14 between a closed, upright position and a reclined position (shown in FIG. 1). In some aspects, an armrest 18 is coupled to the back 14, as further described below. As shown in FIG. 1, in some aspects, the seating unit 10 may include a back shroud 20 and a base shroud 22. In some aspects both back shroud 20 and base shroud 22 may be formed of multiple pieces. Shrouds 20 and 22 may provide privacy to the patrons using the seating unit 10, and may also protect the underlying mechanism 16 from debris.

Figure 2:
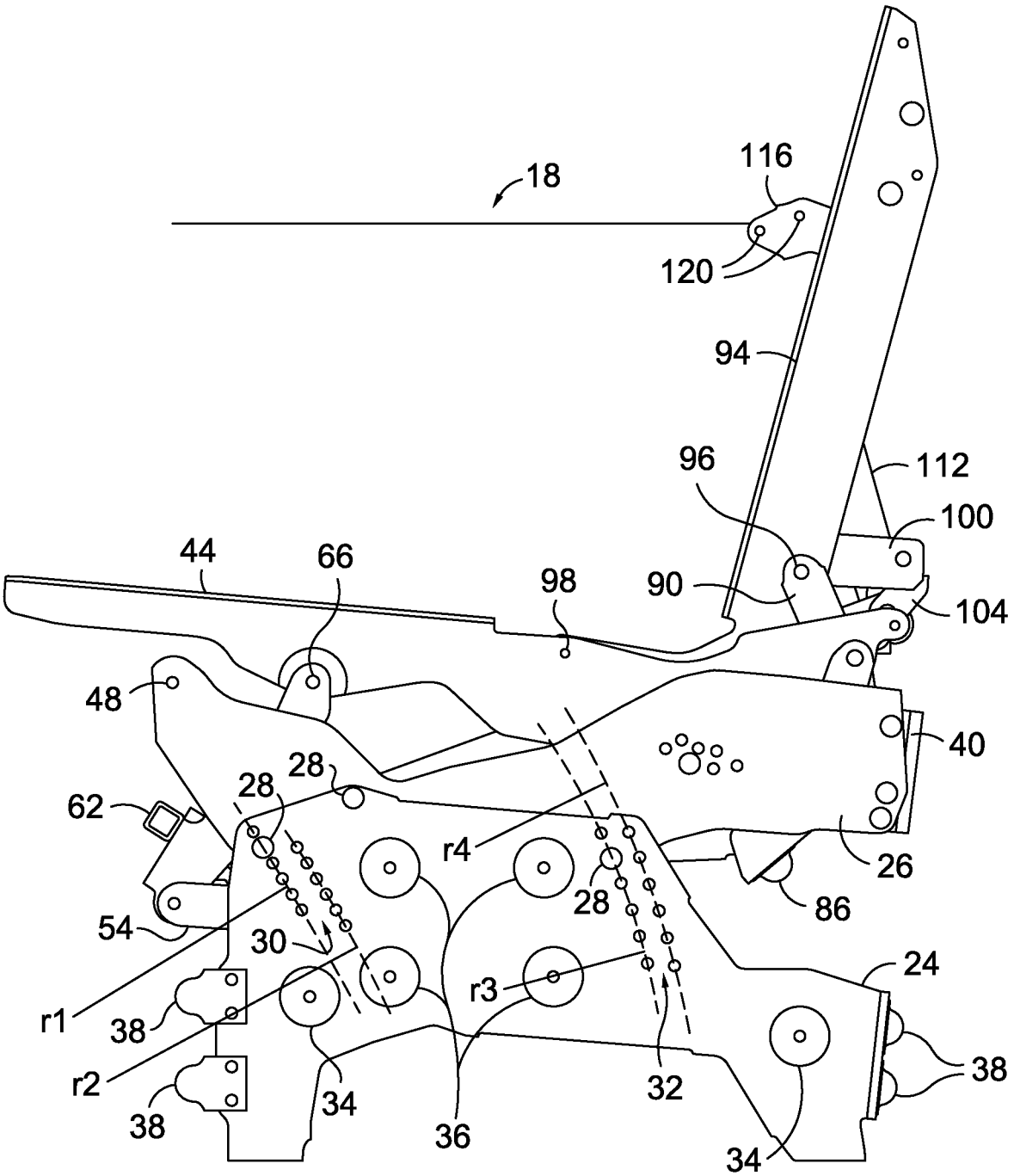
FIG. 2 is a side view of the un-upholstered mechanism of FIG. 1, in the closed position, with the armrest shown schematically, in accordance with aspects hereof.
Figure 3:
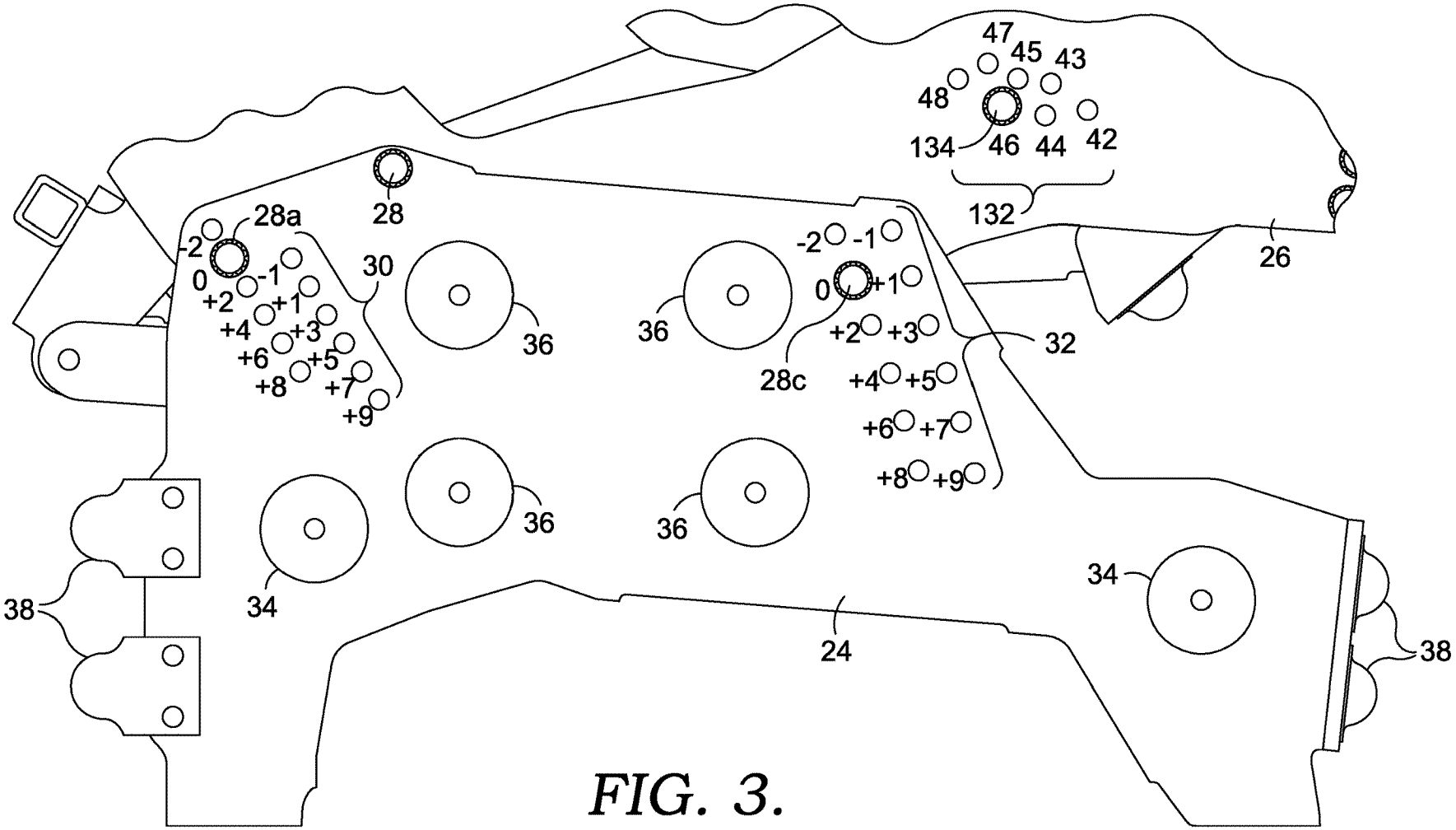
FIG. 3 is an enlarged view of a portion of the components of FIG. 2, in accordance with aspects hereof.

The mechanism 16 is best seen in FIGS. 2-14, with the external parts of seating unit 10 removed. One side of mechanism 16 is shown and described, with the understanding that each side of mechanism 16 mirrors the opposite side. In one aspect, seating unit 10 is supported by side legs 24. As shown in FIG. 2, base plate 26 is coupled to the side leg 24, such as by bolting the base plate 26 to the side leg 24 with bolts 28. As best seen in FIG. 3, side leg 24 has a series of front placement holes 30 and rear placement holes 32 arranged in a spaced, arcuate manner (such as the along the arcuate lines r1, r2, r3 and r4 in FIG. 2). In some aspects, the front placement holes 30 and rear placement holes 32 may be labeled to assist the installer of the seating unit 10. As shown in FIG. 3, the front-most arc of front placement holes 30 and rear placement holes 32 correspond to a floor sloped from −2 degrees to 8 degrees, in two degree increments. Similarly, the rear-most arc of front placement holes 30 and rear placement holes 32 correspond to a floor sloped from −1 degree to 9 degrees in two degree increments. The placement of bolts 28 labeled 28*a* in front placement holes 30 and bolt 28*c* in rear placement holes 32 correspond to the degree of slope on which the seating unit 10 is installed. As shown, bolt 28*a* and bolt 28*c* are in the zero degree position, but can easily be relocated by the installer. This is especially useful when seating unit 10 is installed as a retro-fit into an existing theater with sloped floors, and allows seating unit 10 to be leveled on floors from a minus two degree slope (such as might be encountered at the front of a theater) to a nine degree slope (with positive slopes being more-commonly encountered from the front of a theater to the back). In some aspects, side leg 24 may have front and rear circular embosses 34 that accommodate attachment of the side leg 24 to the shroud base 22. Similarly, in some aspects, side leg 24 may have central circular embosses 36 that accommodate optional accessories, such as a folding, retractable tray table. For stability, the side legs 24 may be coupled together by torque tubes 38 that are coupled to each side leg 24 and extend between the side legs 24.

Figure 4:
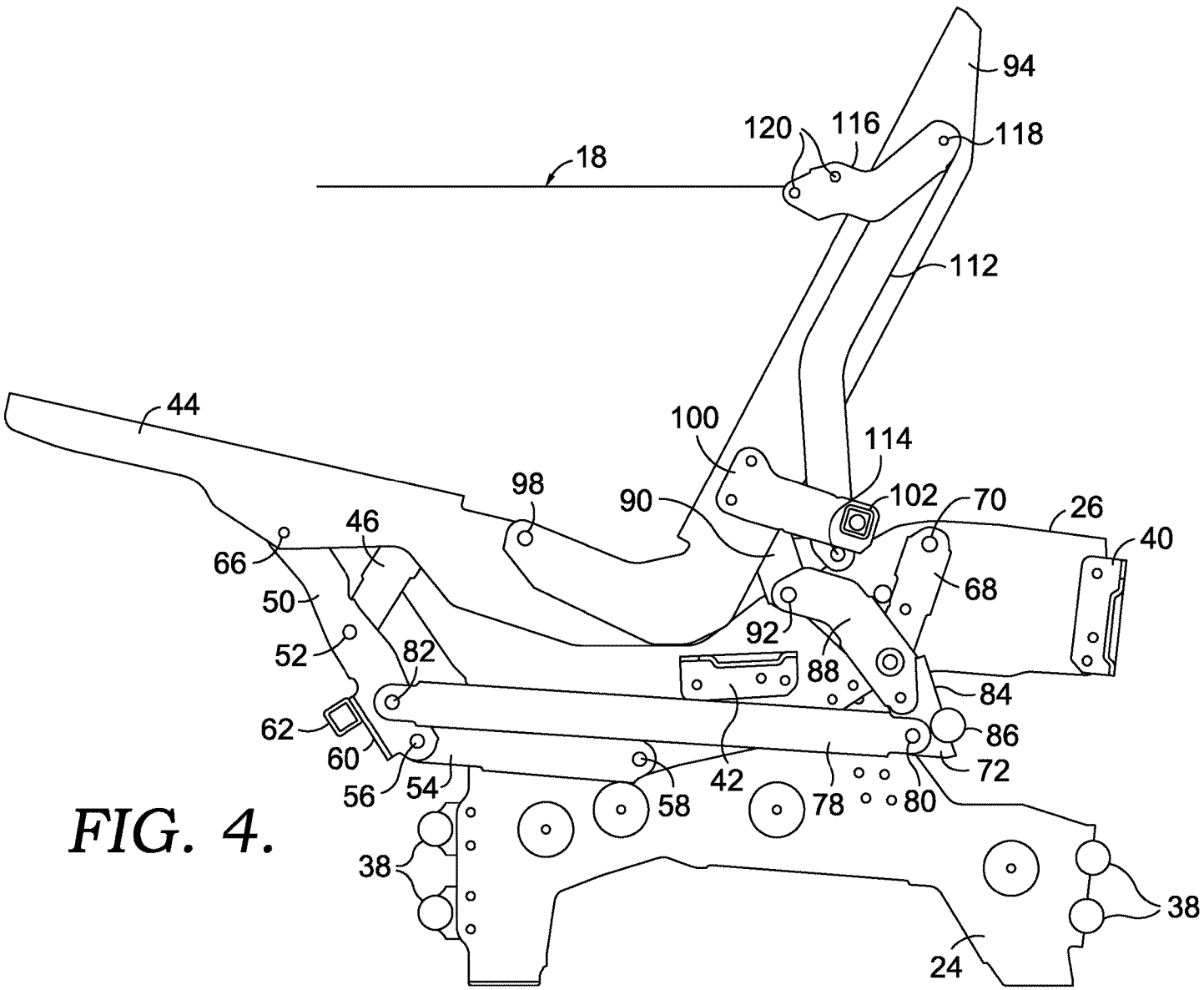
FIG. 4 is a cross-sectional view of the mechanism of FIG. 2, but in a reclined position, in accordance with aspects hereof.
Figure 6:
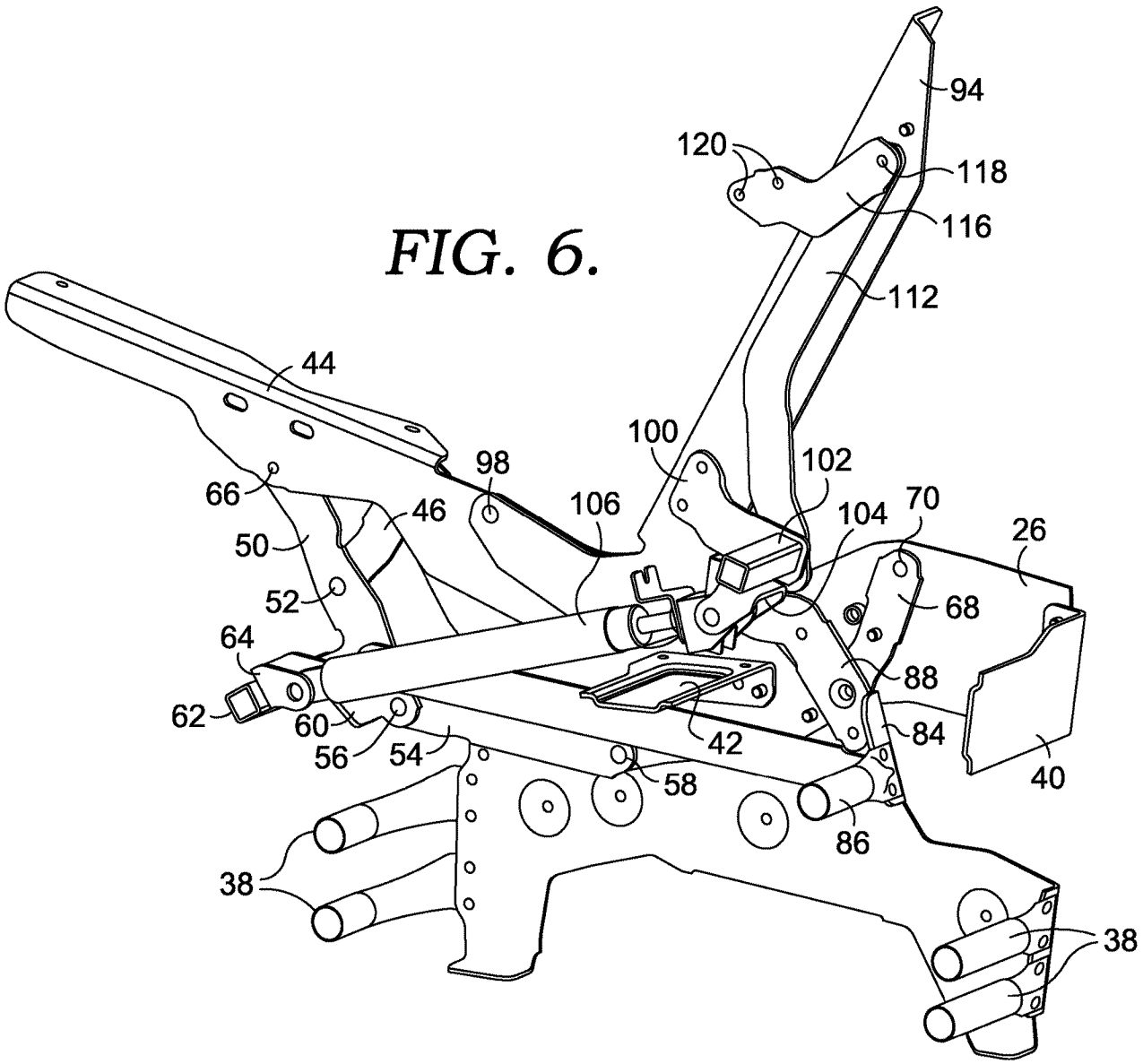
FIG. 6 is a perspective, cross-sectional view of the mechanism in a reclined position, showing the gas spring, in accordance with aspects hereof.

As discussed above, side leg 24 supports a base plate 26. Base plate 26 is fixedly coupled to side leg 24 with bolts 28 extending through front placement holes 30 and rear placement holes 32. Each base plate 26 may further be fixedly coupled to the opposite base plate 26 with a rear brace cross plate 40 and/or a center brace cross plate 42, as seen in FIGS. 4 and 6. Cross plates 40 and 42 may be fixedly coupled to the base plate 26 such as by bolts, rivets or other attaching mechanisms and provide additional stability to reclining mechanism 16.

Figure 5:
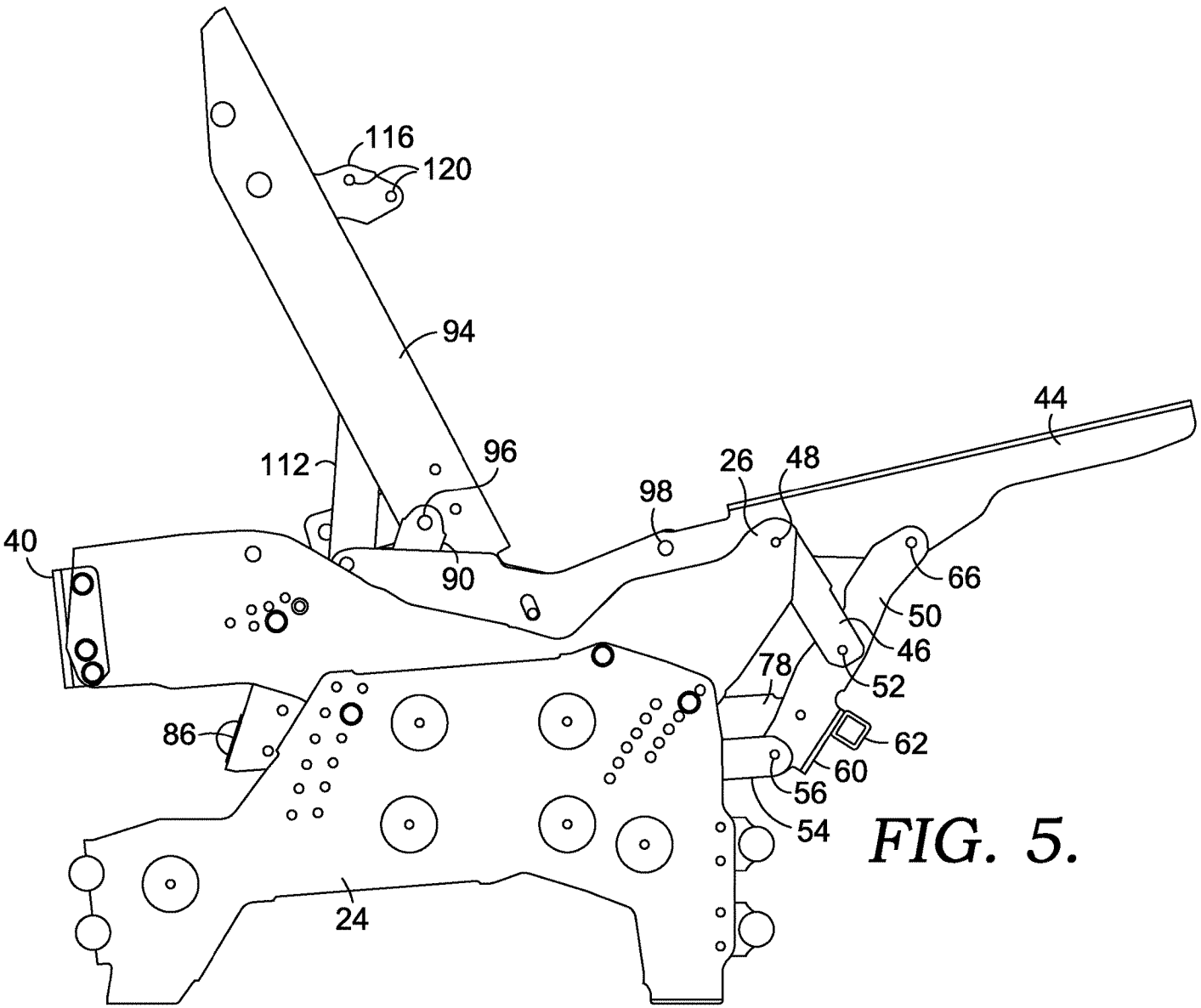
FIG. 5 is a side view of the opposite side of the mechanism of FIG. 4, in accordance with aspects hereof.

As best seen in FIGS. 4 and 6, a seat plate 44 is supported on base plate 26 through a series of links that allow the seat plate 44 to translate forwardly and rearwardly as the mechanism 16 moves from a closed position to a reclined position. Seat plate 44 couples to seat 12 and supports the seat 12. As seen in FIG. 5, front carrier link 46 is pivotally coupled to the base plate 26, near the front of base plate 26, at pivot point 48. The front carrier link 46 extends downwardly from pivot point 48 and is pivotally coupled to a front swing link 50 at pivot point 52, opposite of pivot point 48. Pivot point 52 is generally at the mid-point of front swing link 50. The lower end of front swing link 50 is pivotally coupled to one end of a front control link 54, at pivot point 56. Front control link 54 extends rearwardly from pivot point 56 and the other end of front control link 54 is pivotally coupled to base plate 26 at pivot point 58 as seen in FIG. 4. Front control link 54 may include a flange 60 that extends laterally inwardly. A front motor tube 62 extends between each side of reclining mechanism 16 and is fixedly coupled to a corresponding flange 60 at each end. As shown in FIG. 6, a mounting clevis 64 is fixedly coupled to the front motor tube 62, such as by welding, generally mid-way between the ends of the front motor tube 62, the importance of which is discussed below. Returning to the front swing link 50, the upper end of front swing link 50 is pivotally coupled to seat plate 44 at pivot point 66. The distance from pivot point 48 to pivot point 52 is generally the same as the distance from pivot point 66 to pivot point 52. In some aspects, the distances between these pivot points is the same, within manufacturing tolerances.

Figure 8:
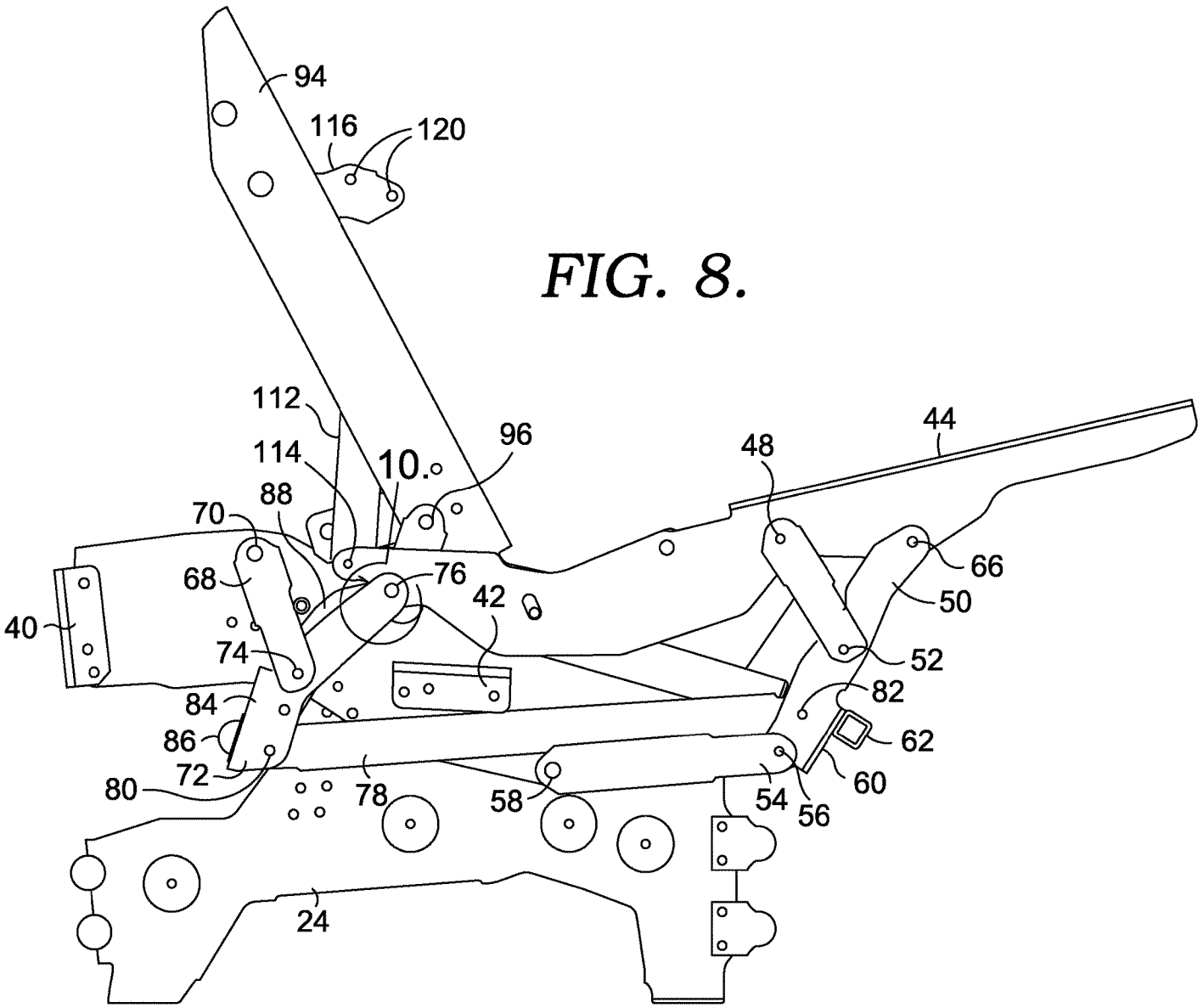
FIG. 8 is a view similar to FIG. 5, shown without one of the side legs and base plates to expose other components, in accordance with aspects hereof.

As best seen in FIG. 4, near the rear end of base plate 26, a rear carrier link 68 is pivotally coupled to base plate 26 at pivot point 70. As best seen in FIG. 8, the rear carrier link 68 extends downwardly from pivot point 70 and is pivotally coupled at the end opposite pivot point 70 to a rear swing link 72 at pivot point 74. The upper end of the rear swing link 72 is pivotally coupled to the seat plate 44, near the rear end of seat plate 44, at pivot point 76. The lower end of the rear swing link 72 is pivotally coupled to a connector link 78 at pivot point 80. The connector link 78 extends forwardly from pivot point 80, and is coupled on the opposite end to front swing link 50 at pivot point 82 just above pivot point 56. Similar to front swing link 50, rear swing link 72 has an inward, laterally extending flange 84 (see FIG. 6). A torque tube 86 extends between opposite flanges 84 and is fixedly attached on each end to a corresponding flange 84, to provide added stability to the reclining mechanism 16.

Figure 9:
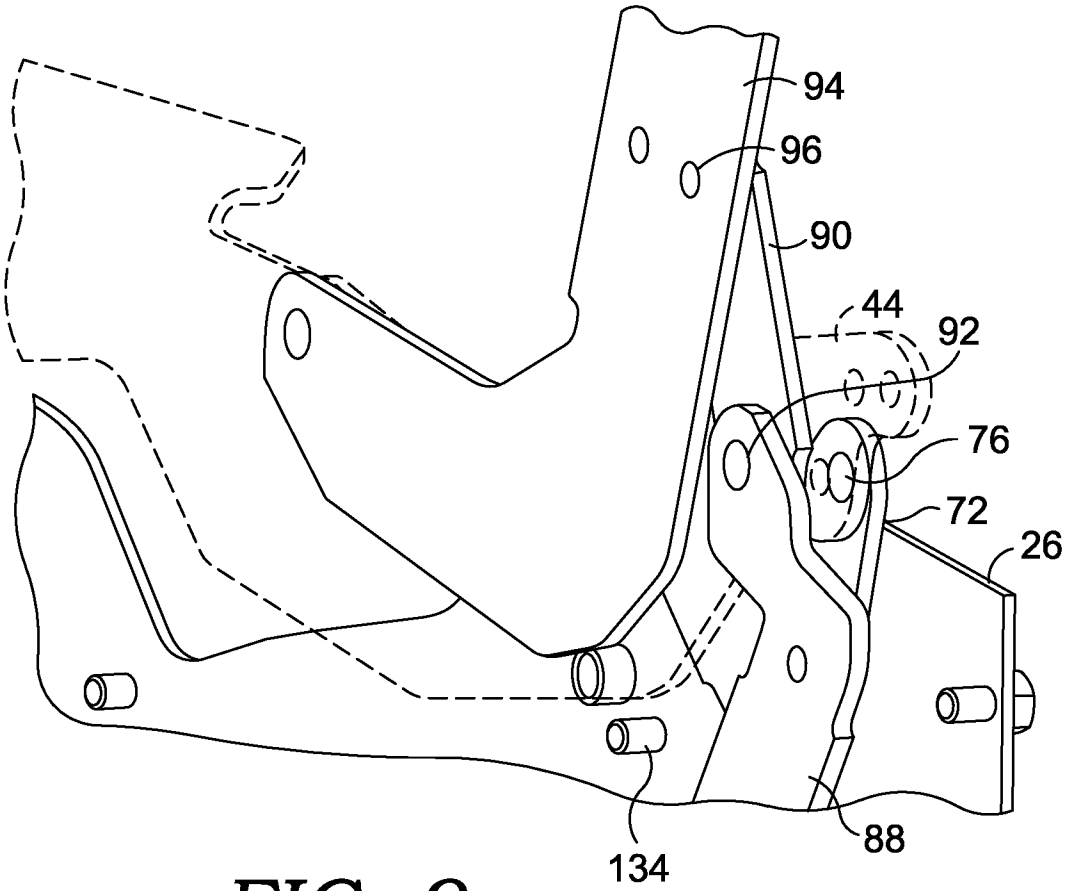
FIG. 9 is an enlarged perspective, partial view of only some components of the mechanism, in accordance with aspects hereof.
Figure 10:
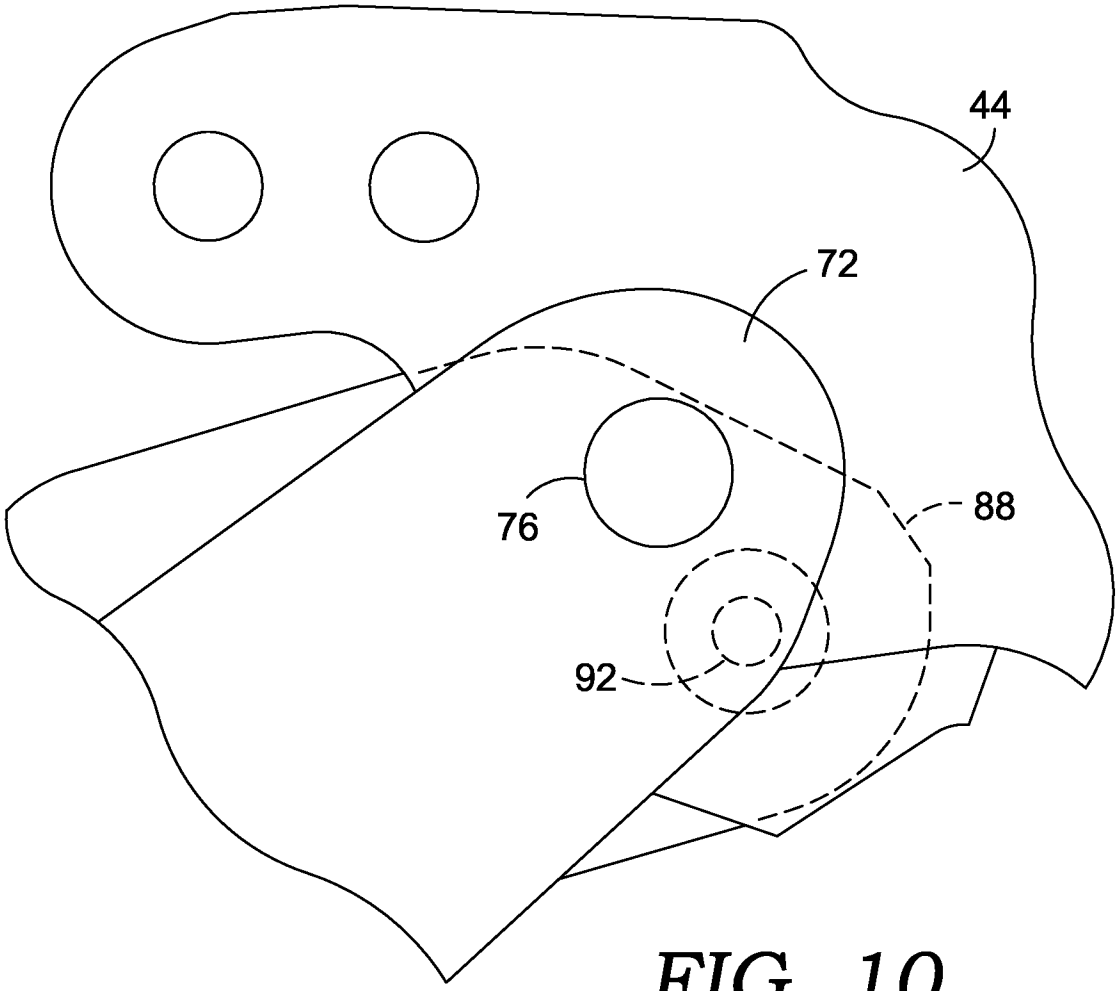
FIG. 10 is an enlarged view of selected pivot points of the encircled portions of the mechanism in FIG. 8, in accordance with aspects hereof.

As best seen in FIG. 4, a back control link 88 is fixedly coupled to the rear swing link 72, such as by rivets 73, and effectively pivots about pivot point 80, following rear swing link 72. The upper end of back control link 88 has an inwardly extending off-set that extends away from rear swing link 72. At the upper end of this offset, the back control link 88 is pivotally coupled to a back support link 90 at pivot point 92. As seen in FIG. 9 and FIG. 10, in effect, the rigidly coupled rear swing link 72 and back control link 88 provide a combo-link with a forked upper end. This allows pivot points 76 and 92 to exist, effectively on one link, even though they are very close to one another. The proximity and off-set of pivot points 76 and 92 allow a desired movement of the back 14, as is further described below.

As seen in FIG. 5, the end of back support link 90 opposite pivot point 92 is pivotally coupled to a back bracket 94 at pivot point 96. As shown in FIG. 4, the back bracket 94 is generally L-shaped, with the lower-front end pivotally coupled to seat plate 44 at pivot point 98. The back bracket 94 is coupled to the back 14 and supports the movement of the back 14. As best seen in FIG. 6, a rear motor tube bracket 100 is fixedly coupled to each back bracket 94. The rear motor tube bracket 100 supports a rear motor tube 102 that is fixedly coupled between opposing rear motor tube brackets 100. A mounting clevis 104 is fixedly coupled to the rear motor tube 102, generally at the midpoint of the rear motor tube 102.

Figure 7:
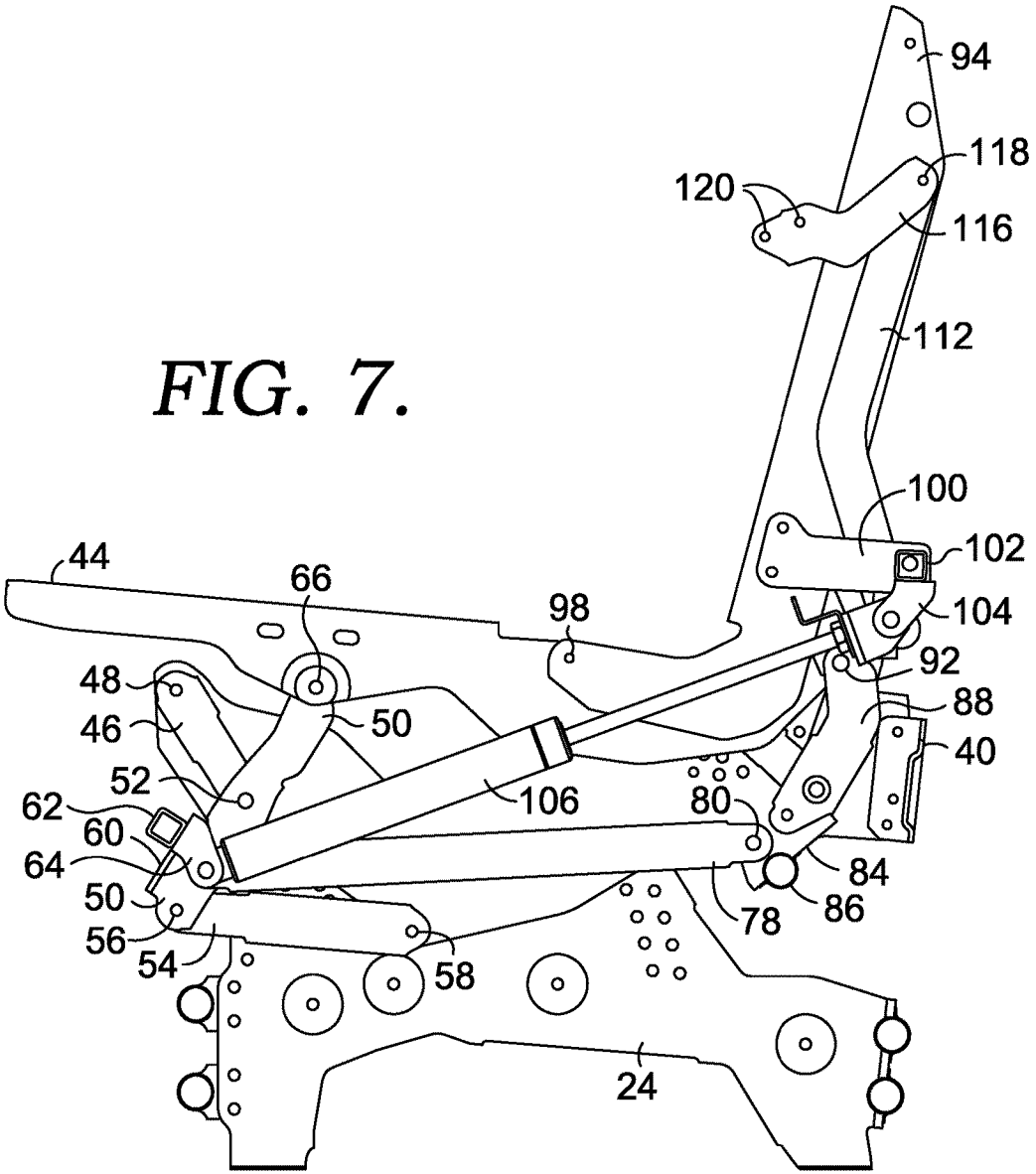
FIG. 7 is a side cross-section view of the recliner mechanism of FIG. 2, in accordance with aspects hereof.

As best seen in FIGS. 6 and 7, in some aspects, reclining mechanism 16 includes a gas spring 106 pivotally coupled on one end to mounting clevis 64, and an extending piston or shaft with an outer end biased outwardly that is pivotally coupled to mounting clevis 104. Gas spring 106 provides a biasing force to the closed position to assist a user in moving the mechanism from the reclined position of FIG. 6 to the closed position of FIG. 7.

Figure 11:
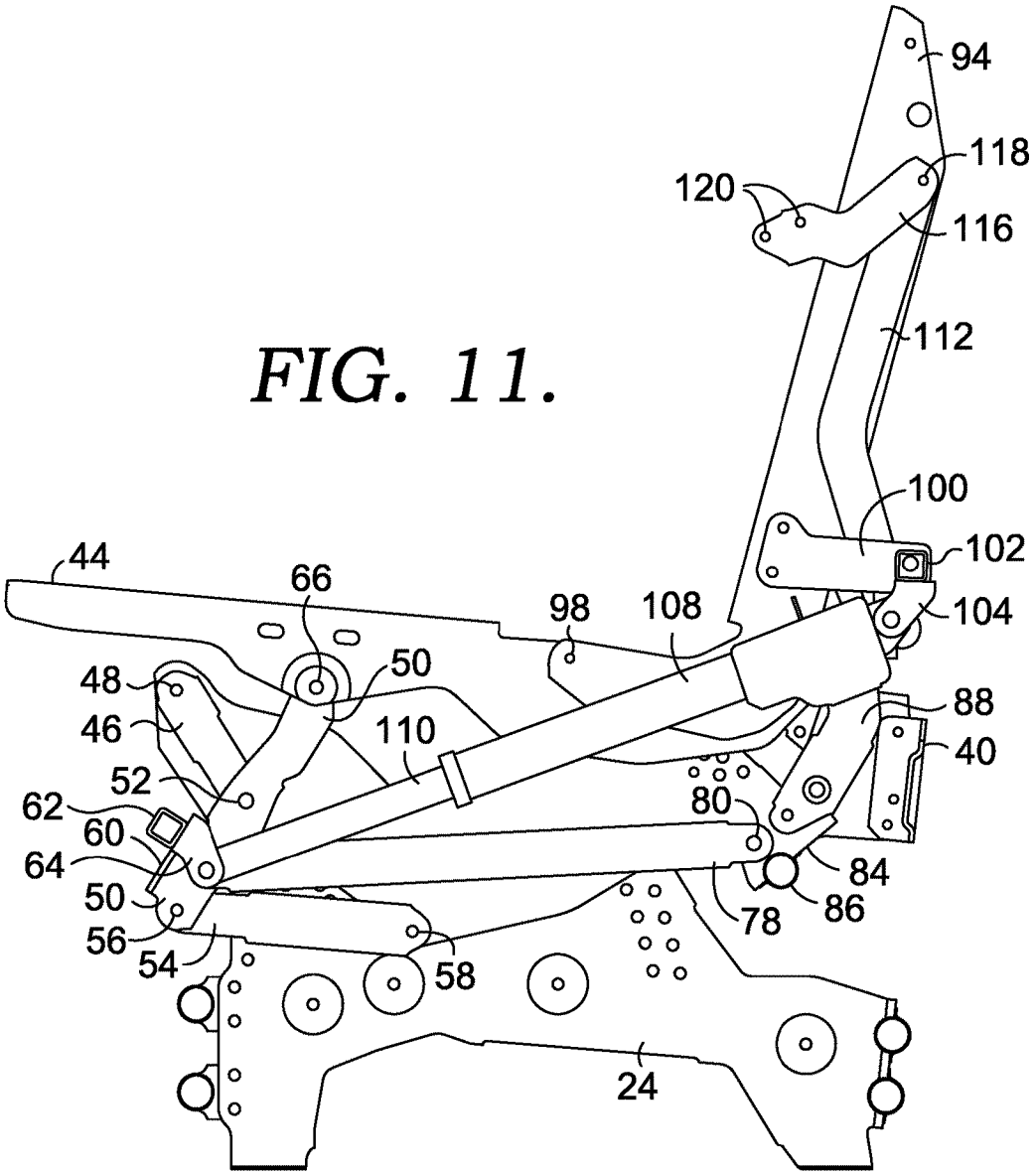
FIG. 11 is a cross-sectional view similar to FIG. 7, showing a motor instead of a gas spring, in accordance with aspects hereof.

In other aspects, as shown in FIG. 11, the reclining mechanism 16 includes a motor 108 that is pivotally coupled on one end to mounting clevis 104. The motor operates to extend and retract a shaft 110 that is pivotally coupled to mounting clevis 64. The operation of the motor, in extending and retracting shaft 110, moves the mechanism between the closed and reclined positions. As would be understood by those in the art, the motor is typically electrically coupled to switches located on the seating unit 10 for operation by a user.

Figure 12:
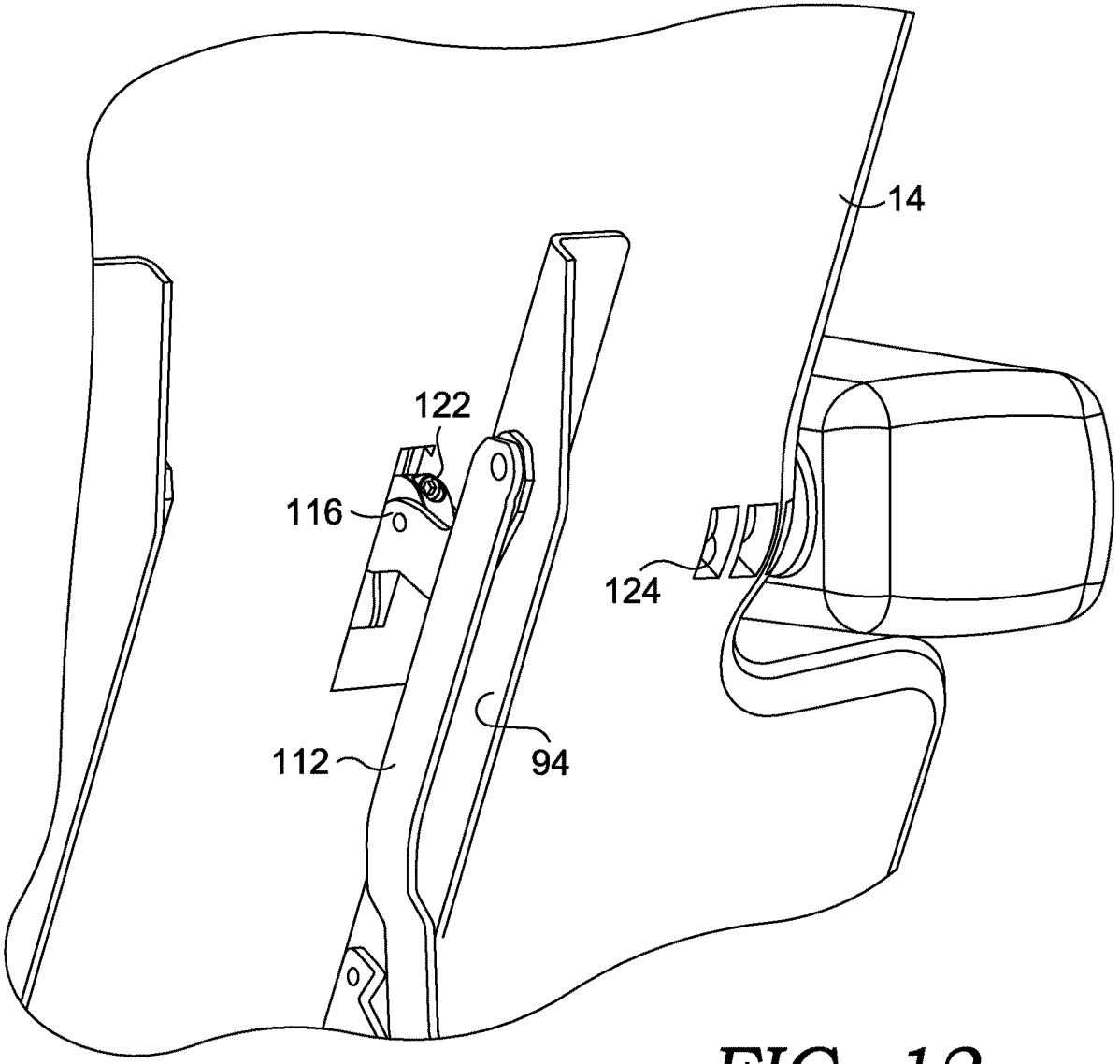
FIG. 12 is a partial rear perspective view of the seating unit of FIG. 1, in accordance with aspects hereof.

As described above, in some aspects seating unit 10 includes an armrest 18. The armrest 18 may be supported by a linkage that maintains the armrest 18 in a horizontal position, even as the seat 12 and back 14 move. In a theater, this aspect is beneficial to keep beverages resting on or in the armrest 18 from spilling. As seen in FIG. 4, the armrest linkage includes an armrest control link 112 that is pivotally coupled on a lower end to seat plate 44 at pivot point 114. The armrest control link 112 extends upwardly and bends to generally follow the back bracket 94. The upper end of armrest control link 112 is pivotally coupled to an armrest lever 116 at pivot point 118. Armrest lever 116 extends forwardly from pivot point 118 beyond back bracket 94. The forward end of armrest lever 116 has mounting holes 120. In some aspects, a split-collar is mounted to armrest lever 116 using mounting holes 120. As seen in FIG. 12, the split-collar has a screw 122 that is used to couple the split-collar to an armrest shaft 124 that can extend through a frame of back 14 and into the armrest 18. As the reclining mechanism moves from the closed position to the reclined position, the armrest control link 112 and armrest lever 116 move relative to the seat plate 44 and back bracket 94 to maintain the armrest 18 in a horizontal position. FIGS. 2 and 4 schematically show the armrest in this horizontal position, even as the back bracket 94 moves to recline.

Figure 13:
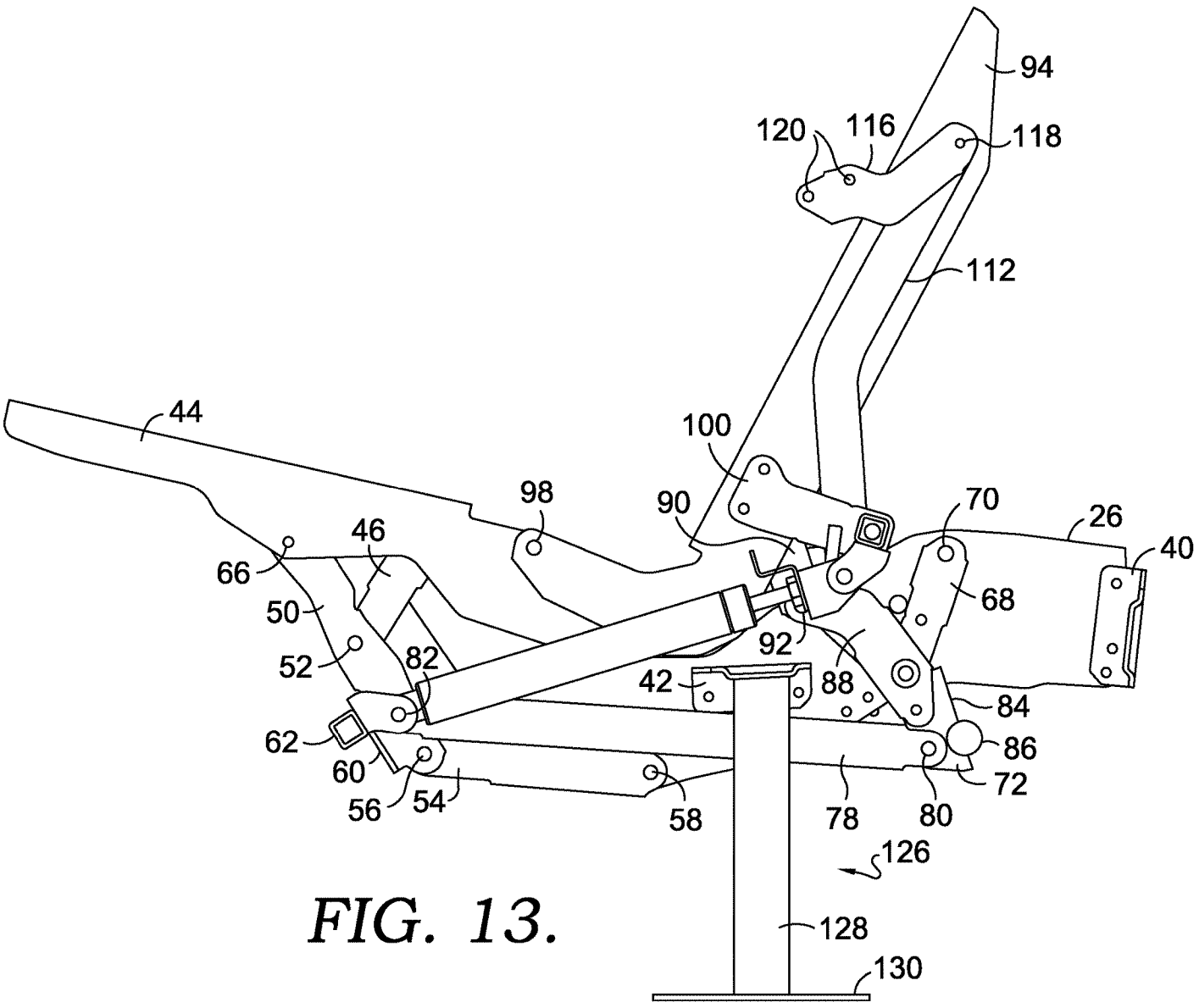
FIG. 13 is a view similar to FIG. 7, showing a pedestal base, in accordance with aspects hereof.

In some aspects, the reclining mechanism 16 is not supported by side legs 24, but is instead supported by a pedestal base 126. As seen in FIG. 13, the pedestal base 126 can be fixedly coupled to the center cross brace plate 42. In some aspects, the pedestal base 126 has a rectangular support column 128 to space the reclining mechanism 16 above the floor, and a mounting flange 130 to couple the reclining mechanism 16 to the floor. The shape and configuration of the pedestal base 126 could be altered for stylistic or design reasons. The pedestal base 126 offers an alternative mounting option for theaters, and may be easier in some environments to clean and maintain.

Figure 14:
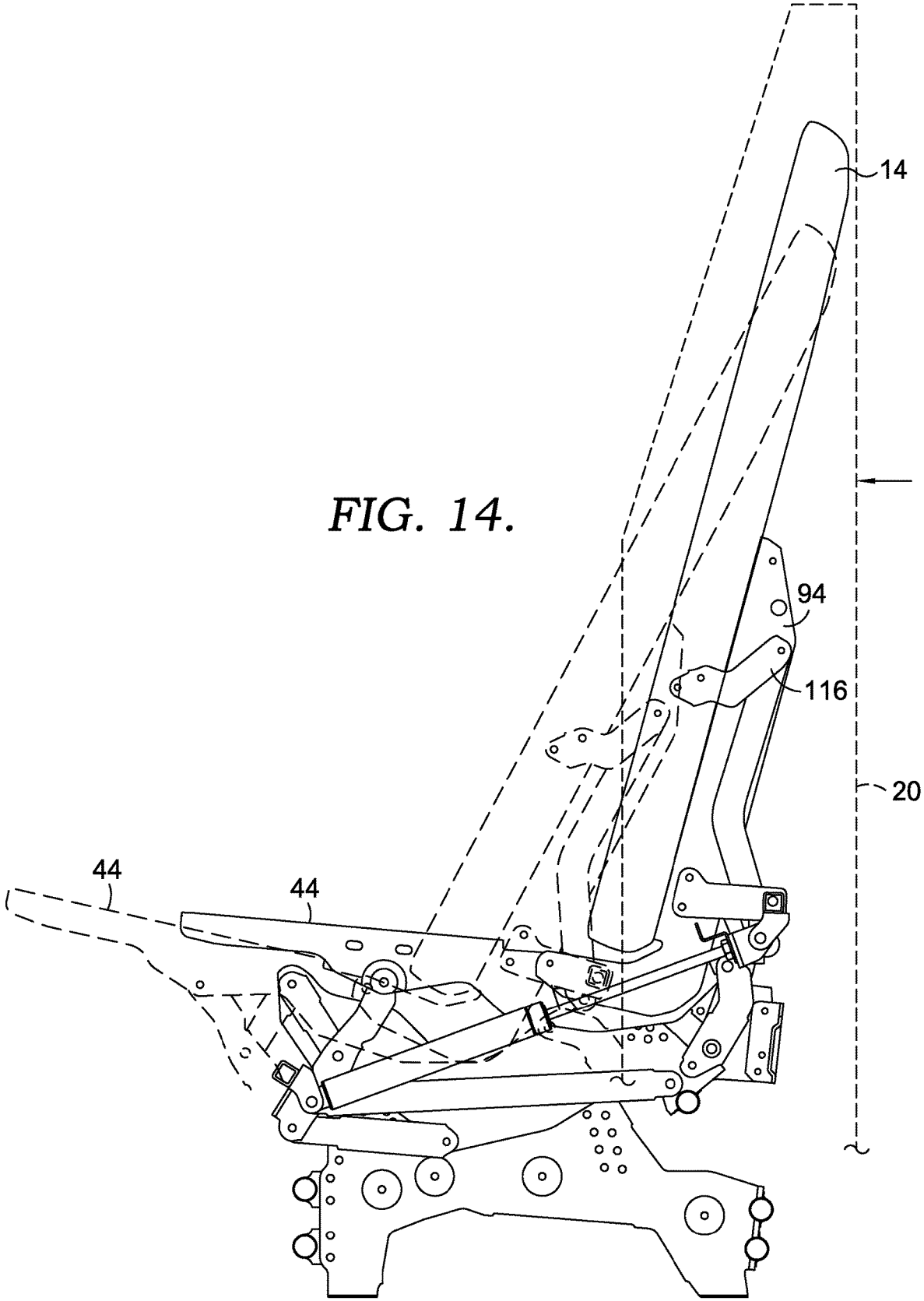
FIG. 14 is a side view of the mechanism in solid lines in the closed position and with portions shown in hidden lines in the reclined position, and also showing the back shroud in hidden lines, in accordance with aspects hereof.

The mechanism 16 described above controls the movement of the seating unit 10 and allows it to move between a closed position as shown, for example, in FIG. 2, to a reclined position as shown in FIG. 1. As the mechanism 16 moves to the reclined position, the seat 12 moves forwardly, and any point taken on seat plate 44 moves in a straight-line, as seen in FIG. 14. This straight-line translation of the seat plate 44 is possible due to the relationship of the links connecting the seat plate 44 to the base plate 26. More specifically, at the front end, (see FIG. 5) the distance from pivot point 48 (coupling front carrier link 46 to base plate 26) to pivot point 52 (coupling front carrier link 46 to front swing link 50) is the same as the distance from pivot point 52 to pivot point 66 (coupling front swing link 50 to seat plate 44)(see FIG. 8). Similarly, the distance from pivot point 70 (coupling rear carrier link 68 to base plate 26) to pivot point 74 (coupling rear carrier link 68 to rear swing link 72) is the same as the distance from pivot point 74 to pivot point 76 (coupling rear swing link 72 to seat plate 44). Because these distances are equal (within manufacturing tolerances), the arc of one link effectively cancels out the arc of the adjacent link in the triangle, resulting in a straight line movement of any point on the seat plate 44. Effectively, one link (front swing link 50 or rear swing link 72) is swinging one way as the other link (front carrier link 46 or rear carrier link 68) is swinging in an opposite way. Note that while the movement of any point on the seat plate 44 is in a straight line, the angle of the seat plate 44 does change. More specifically, the rear of the seat plate 44 will drop relative to the front of seat plate 44, resulting in a change in the pitch or angle of the seat plate 44 in the reclined position.

As the seat plate 44 moves forwardly from the closed position to the reclined position, as described above, the back bracket 94 also moves forwardly and down. The linkage connecting the back bracket 94 controls the movement of the back bracket 94, such that a projected point of the top of the back 14 moves down in approximately the same plane, allowing the back shroud 20 to be used such that the back 14 does not contact back shroud 20 as can be seen in FIG. 14. In FIG. 14, the closed position is shown in solid lines. The seat plate 44, back bracket 94 and armrest lever 116, along with the back 14 are shown in hidden lines in the reclined position. This movement also ensures the back 14 will not move rearwardly into the space in the row immediately behind seating unit 10 in a theater. Generally, the reclining mechanism 16 is designed such that a back 14 with a projected top point extends between about fifteen inches and sixteen inches above the top of back bracket 94, and in some aspects the top of the back 14 is about 15.5 inches above the top of back bracket 94. It is this projected top point of back 14 that moves downwardly in the same plane to achieve the desired results.

As best seen in FIG. 3, the base plate 26, in some aspects, has a series of spaced holes 132 that can be used to easily adjust reclining mechanism 16 to accommodate for different riser lengths in theaters. As shown, the series of holes 132 are labeled to accommodate riser lengths between 42 and 48 inches. To adjust for riser length, a bolt 134 (or a similar stop mechanism) is installed in the hole corresponding to the appropriate riser length. As shown in FIG. 3, the bolt 134 is installed in the hole 132 corresponding to a riser length of 46 inches. In use, as reclining mechanism 16 moves to the reclined position, the rear carrier link 68 will stop when it hits the bolt 134, effectively stopping any further recline of recline mechanism 16. In some aspects, rear carrier link 68 has a stop section designed to contact the bolt 134. By relocating the bolt 134, installers can easily adjust reclining mechanism 16 to accommodate different length risers.

Persons familiar with the field of the invention will realize that it may be practiced by various devices which are different from the specific illustrated embodiments. Therefore, it is emphasized that the invention is not limited only to this embodiment but is embracing of a wide variety of mechanisms which fall within the spirit of the following claims.

What is claimed:

1. A theater seating unit, comprising:

a pair of spaced apart legs, each of the legs having at least a first plurality of front placement holes and at least a first plurality of rear placement holes;

a recline linkage mounted to and between the pair of spaced apart legs, the recline linkage including at least a pair of base plates, each base plate coupled to an adjacent one of the pair of spaced apart legs utilizing a selected one of the first plurality of front placement holes and a selected one of the first plurality of rear placement holes;

a seat mounted to the recline linkage; and a back mounted to the recline linkage;

wherein the angle of the seating unit with respect to the legs can be altered by utilizing different ones of the first plurality of front placement holes and rear placement holes.

2. The theater seating unit of claim 1, wherein the legs further comprise at least a second plurality of front placement holes and at least a second plurality of rear placement holes, and wherein each base plate is coupled to an adjacent one of the pair of spaced apart legs utilizing a selected one of either the first plurality of front placement holes or the second plurality of front placement holes, and a selected one of either the first plurality of rear placement holes or the second plurality of rear placement holes.

3. The theater seating unit of claim 2, wherein the first plurality of front placement holes are spaced apart to form an arcuate shape and the first plurality of rear placement holes are spaced apart to form an arcuate shape.

4. The theater seating unit of claim 3, wherein the second plurality of front placement holes are spaced apart to form an arcuate shape and the second plurality of rear placement holes are spaced apart to form an arcuate shape.

5. The theater seating unit of claim 4, wherein the arcuate shape of the first plurality of front placement holes is spaced from the arcuate shape of the second plurality of front placement holes.

6. The theater seating unit of claim 4, wherein the arcuate shape of the first plurality of rear placement holes is spaced from the arcuate shape of the second plurality of rear placement holes.

7. The theater seating unit of claim 6, further comprising indicia embossed on at least one of the pair of legs, the indicia indicating a corresponding angle between the legs and the base plate with respect to each of the first plurality of front placement holes, the second plurality of front placement holes, the first plurality of rear placement holes and the second plurality of rear placement holes.

8. The theater seating unit of claim 7, further comprising a pair of shroud embosses on each leg; and a base shroud coupled to a corresponding leg utilizing the shroud embosses on the leg.

* * * * *